US005893529A

United States Patent [19]

Bradersen et al.

[11] Patent Number: 5,893,529

[45] Date of Patent: Apr. 13, 1999

[54] DEVICE FOR UNROLLING ONE-SIDED SELF-ADHESIVE MATERIAL LOCATED ON A ROLL

[75] Inventors: Hans-Jürgen Bradersen; Reiner Schulze; Gerd Hebbel; German Patiño, all of Hamburg; Johannes Steinforth, Bliedersdorf, all of Germany

[73] Assignee: Beiersdorf AG, Hamburg, Germany

[21] Appl. No.: 09/017,091

[22] Filed: Feb. 2, 1998

[30] Foreign Application Priority Data

Feb. 7, 1997 [DE] Germany ..... 197 04 559

[51] Int. Cl.[6] ..... B65H 23/182

[52] U.S. Cl. ..... 242/413.6; 242/564.3; 242/564.5

[58] Field of Search ..... 242/413.6, 420, 242/420.1, 420.4, 420.5, 420.6, 564.5, 542.4

[56] References Cited

U.S. PATENT DOCUMENTS

| | | | |
|---|---|---|---|
| 2,168,159 | 8/1939 | Hartt | 242/564.5 |
| 2,398,879 | 4/1946 | Bouget | 242/564.5 |
| 2,438,296 | 3/1948 | Nassimbene | 242/542.4 |
| 3,279,717 | 10/1966 | Schubert | 242/564.5 |
| 3,306,544 | 2/1967 | Davis | 242/542.4 |
| 3,334,838 | 8/1967 | Kopp | 242/420.1 |
| 3,348,787 | 10/1967 | Giles | 242/420.1 |
| 3,684,273 | 8/1972 | Benson et al. | 242/420.1 |
| 3,861,610 | 1/1975 | Landis et al. | 242/542.4 |
| 4,004,748 | 1/1977 | Schwarz | 242/542.4 |
| 4,026,487 | 5/1977 | Ales, Jr. | 242/564.5 |
| 4,530,471 | 7/1985 | Inoue | 242/420.1 |
| 4,573,618 | 3/1986 | Kikuchi | 242/564.5 |

FOREIGN PATENT DOCUMENTS

| | | | |
|---|---|---|---|
| 2.225.022 | 10/1974 | France | 242/564.5 |
| 226 540 A1 | 8/1985 | German Dem. Rep. | 242/420.1 |
| 2-28453 | 1/1990 | Japan | 242/564.5 |
| 4-251061 | 9/1992 | Japan | 242/420.6 |

*Primary Examiner*—John P. Darling

*Attorney, Agent, or Firm*—Sprung Kramer Schaefer & Briscoe

[57] ABSTRACT

Device for unrolling one-sided self-adhesive material (12) located on a roll (1), comprising two holders (2), each of which has a cut-out (21) to accommodate the roll (1) and which are arranged in such a way that they form a slotted guide for the roll (1) located between them, a driven draw-off roll (5), which has elastic material (52) wound around it and is arranged in such a way that the material (12) is drawn off the roll (1) using the non-adhesive side over the draw-off roll (5), the roll (1) being held by the slotted guide in direct contact with the draw-off roll (5) over the entire width of the roll (1).

6 Claims, 1 Drawing Sheet

DEVICE FOR UNROLLING ONE-SIDED SELF-ADHESIVE MATERIAL LOCATED ON A ROLL

Figure 1:
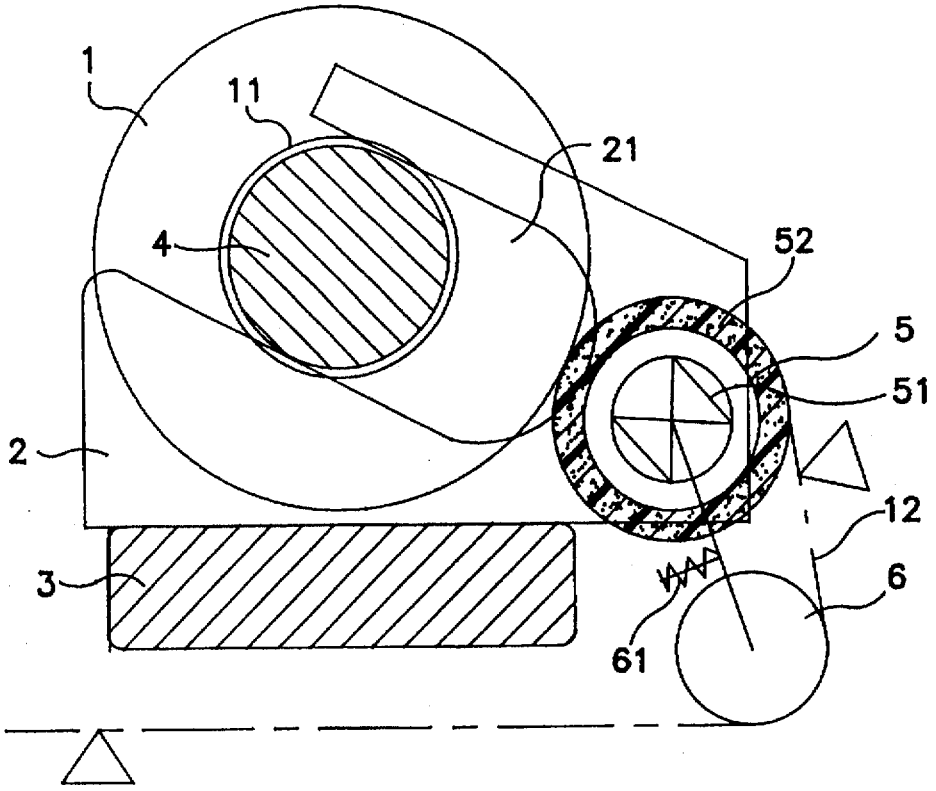

The invention relates to a device using which one-sided self-adhesive material located on a roll can be unrolled.

The unwinding of broad rolls made of self-adhesively coated materials, for example from rolls having a width of one metre, is in particular very difficult. It is known to hold a roll of this type by means of an appropriate device, and to draw off the material from the roll using a permanently installed and driven draw-off roll. As a result of the fact that the diameter of the roll decreases in the course of time, the distance between the roll and draw-off roll increases continuously. The consequence of this is that at the draw-off point of the material from the roll, continuously changing relationships are established. The fluctuating tensile stresses resulting from this in the unwound material make it more difficult to use the latter in subsequent process steps. In order to avoid this disadvantage, the draw-off roll can be tracked, using a corresponding controller, in such a way that the roll and the draw-off roll are held in continuous contact. However, the very complicated and expensive adjusting mechanism, including the controller, opposes the advantage of uniform unwinding of the material.

The object of the invention was to provide a device which, given a very simple configuration in constructional terms, makes possible the uniform drawing off of a one-sided self-adhesive material from a roll.

This object is achieved by means of the present invention. Developments of the device according to the invention are the subject-matter of the subclaims.

Accordingly, the device for unrolling one-sided self-adhesive material located on a roll comprises two holders, each of which has a cut-out to accommodate the roll and which are arranged in such a way that they form a slotted guide for the roll located between them, and furthermore comprises a driven draw-off roll, which has elastic material wound around it and is arranged in such a way that the material is drawn off the roll over the draw-off roll using the non-adhesive side, the roll being held by the slotted guide in direct contact with the draw-off roll over the entire width of the roll.

The cut-outs in the holders preferably have the shape of an upwardly open, inclined "U", the angle of the inclination being able to lie between 10° and 80°. The cut-outs are used to accommodate the roll core, onto which the self-adhesively coated material is wound. If the roll core does not project beyond the lateral edge of the material roll, mandrels are used to accommodate the roll, which are pushed into the roll core and reach into the cut-outs. As a result of this type of slotted guide, the roll sinks into the holders, as a result of its own weight, to such an extent that it rests firmly on the driven draw-off roll, to be specific over the entire width of the roll.

On the draw-off roll there is an elastic material. As a result of using the elastic material, on the one hand a particularly non-damaging drawing off of the material from the roll is achieved, since the elastic material is able to compensate extremely well for small unevennesses on the roll, because of the elasticity. On the other hand, the elastic material results in an increased coefficient of friction between material and draw-off roll, with the result that, in particular, even strongly adhering materials can be drawn off on the draw-off roll, in the case of possible small wrap angles. The elastic material acts in a manner comparable with a spring, so that in conjunction with the slotted guide, approximately constant conditions prevail over the entire length of the draw-off line during the unwinding of the roll, especially since during the unwinding operation the roll is additionally pulled onto the draw-off roll by the forces occurring as a result of the construction. In this case, the use of foamed material as elastic material has proven to be particularly advantageous, quite particularly if this is present in the form of a continuous web and is self-adhesively coated and is applied to the draw-off roll in a spiral, gap-free winding.

The drive of the draw-off roll can be performed by means of a conventional electric motor, which is fitted, for example, in the draw-off roll. However, a frictional drive via belts is also possible.

For the switching of the drive of the draw-off roll, use is preferably made of a switching mechanism which is actuated by tension on the material. If the material is pulled downstream of the device, a tension is built up in the material, which can be used to trigger a switch, for example in the form of a spring-loaded switching roll, over which the material is guided, and which is arranged downstream of the draw-off roll. As a result of the growing tension in the material, in this case the spring used for the support is compressed, until a position is reached in which a contact is triggered which, in turn, is used to switch on the drive of the draw-off roll. On the other hand, if the tension in the material relaxes, for example as a result of a breakage, the switching roll is pressed by the expanding spring beyond the normal position against a second contact, which effects the immediate switching off of the drive. Uncontrolled unwinding of the web is thus virtually impossible.

Instead of being wound around with elastic material, the draw-off roll can also be constructed as a suction roll. Depending on the draw-off force necessary, in this case the vacuum in the draw-off roll preselected in order to ensure reliable drawing off of the material from the roll.

In the case of strongly adhering materials, in particular, the use of a guide roll between roll and draw-off roll proves to be advantageous. The guide roll is in direct contact with the roll over the entire width of the roll, the drawing off of the material being performed over the guide roll using the non-adhesive side. There is no contact between guide roll and draw-off roll and, respectively, draw-off roll and roll. Since the guide roll reduces the draw-off angle of the material from the roll, which leads to a further increase in the uniformity of drawing off and, associated with this, to a reduction in the loading of the material, the diameter of the guide roll is selected to be as small as possible. However, the forces occurring during drawing off, which can be considerable, in particular in the case of broad rolls having strongly adhering material, have the effect that the diameter of the guide roll cannot be selected to be too small. This is because an adequate strength of the guide roll must be ensured. In addition, a distinct reduction in the drawing-off noise results from the use of the guide roll. The guide roll can also be implemented as a guide profile instead of as a roll.

The device according to the invention is suitable for unwinding a multiplicity of self-adhesively coated materials. However, it proves to be particularly advantageous to use the device for unrolling large-area, one-sided self-adhesive material which is used to protect surfaces, preferably surfaces of car bodies, quite particularly preferably of painted car bodies.

As a result of the simple configuration in constructional terms, in particular in the case of broad material webs, the device is suitable for starting the unwinding operation by pulling manually on the material. The material supplied by the device can then be applied to the desired areas by hand. However, the use of the device according to the invention in semi-automatic or automatic application is also possible without restriction.

Downstream of the device, the material can be further processed in an appropriate manner. Thus, the combination of the device with a cutting device to produce pieces cut to length does not lie outside the concept of the invention either.

In the following text, using two figures, the device according to the invention and a preferred embodiment of the same are explained in more detail.

As illustrated in FIG. 1, the roll (1) having the self-adhesively coated material is located between two holders (2), which are fastened onto a cross-member (3). In order to fix the roll (1), use is made of two mandrels (4), which are pushed into the roll core (11) of the roll (1). Each of the two holders (2) has a U-shaped cut-out (21). The inclination of the cut-out (21) ensures that the roll (1), as a result of the inherent force of gravity, rests firmly over the entire width of the roll (1) on the draw-off roll (5), in the interior of which the drive motor (51) is located. Furthermore, a foamed material layer (52) is applied to the draw-off roll (5) as the elastic material. During operation, the draw-off roll (5) drives the roll (1). At the line at which the draw-off roll (5) and the roll (1) touch, at the same time the removal of the material (12) from the roll (1) takes place, specifically in a particularly non-damaging manner because of the foamed material layer (52), the material (12) running with the non-adhesive side over the draw-off roll (5). The material (12) is fed to a switching roll (6) over the draw-off roll (5). With the aid of the spring (61), the switching roll (6) is able to switch the drive motor (51) of the draw-off roll (5) on or off, depending on the tension in the web of material (12). Downstream of the switching roll (6), the material (12) is guided into the further processing steps, which are not illustrated in more detail here.

Figure 2:
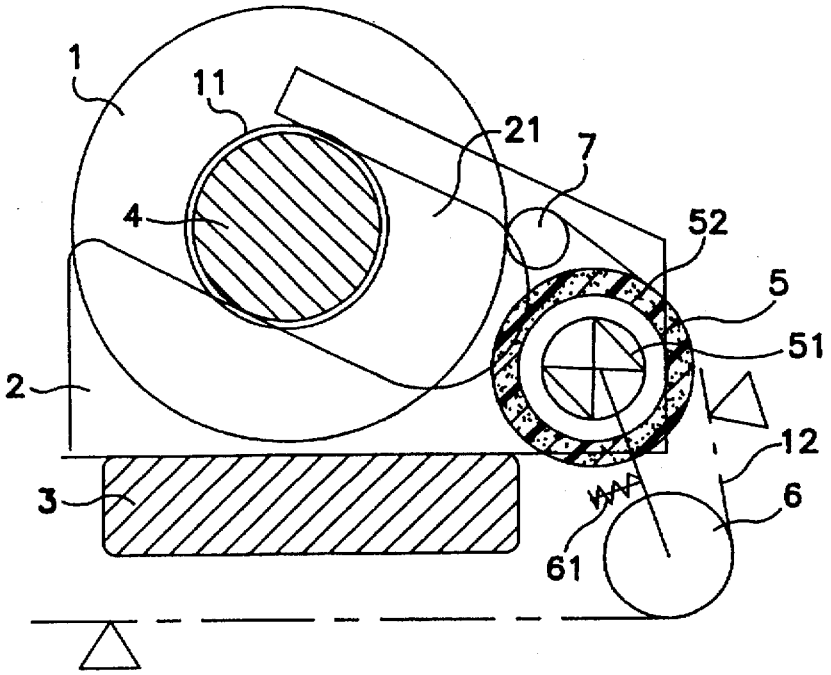

A preferred embodiment of the device is shown in FIG. 2. In addition to the components already described in FIG. 1, the device has, between the roll (1) and the draw-off roll (5), the guide roll (7) which, on account of its low diameter, severely restricts the possible draw-off angle of the material (12) from the roll (1), and thus leads to the removal of the material (12) being improved once more. In this case, a suitable drive for the guide roll (7) is not provided.

We claim:

1. Device for unrolling one-sided self-adhesive material (12) wound on a roll (1), comprising two holders (2), each of which has a cut-out (21) to accommodate the roll (1) and which are arranged in such a way that they form a slotted guide for the roll (1) located between them, a draw-off roll (5), driven by a drive mechanism (51) and having an elastic material (52) wound around it, and a guide roll (7), said guide roll (7) being between said roll (1) and said draw-off roll (5) and in direct contact with the non-adhesive side of material (12) on roll (1) over the entire width of said roll (1), said draw-off roll (5) not touching said roll (1) and said guide roll (7) not touching said draw-off roll (5), whereby in operation said material (12) is drawn off said roll (1) by draw-off roll (5), passing first over guide roll (7) and then passing from guide roll (7) to and over draw-off roll (5), said guide roll (7) and draw-off roll (5) being in contact with the non-adhesive side of said material (12).

2. A method for unrolling a one-sided self-adhesive material which is wound upon a roll, which comprises unrolling said material with the device of claim 1.

3. Device according to claim 1, further comprising a switching mechanism which is actuated by tension on the material 12 and which switches drive mechanism (51) on or off.

4. Device according to claim 3, wherein the switching mechanism is formed by a switching roll (6) which is supported by a spring (61), over which roll (6) the material (12) is guided, and which roll (6) is arranged downstream of the draw-off roll (5).

5. Device according to claim 1, wherein the elastic material (52) on the draw-off roll (5) is foamed material.

6. Device according to claim 5, wherein the foamed material is present in the form of a continuous web and is self-adhesively coated, and is applied to the drawoff roll (5) in a spiral, gap-free winding.

* * * * *

UNITED STATES PATENT AND TRADEMARK OFFICE

CERTIFICATE OF CORRECTION

PATENT NO. : 5,893,529

DATED : April 13, 1999

INVENTOR(S) : Bradersen, et al.

It is certified that error appears in the above-identified patent and that said Letters Patent is hereby corrected as shown below:

Col. 4, line 39 Delete " drawoff " and substitute -- draw-off --

Signed and Sealed this

Sixteenth Day of November, 1999

*Attest:*

Q. TODD DICKINSON

*Attesting Officer*

*Acting Commissioner of Patents and Trademarks*